US011119445B2

(12) United States Patent
Peters

(10) Patent No.: US 11,119,445 B2
(45) Date of Patent: Sep. 14, 2021

(54) ASTRONOMICAL HOROLOGICAL DEVICE

(71) Applicant: ETA SA Manufacture Horlogere Suisse, Grenchen (CH)

(72) Inventor: Jean-Bernard Peters, Pieterlen (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 342 days.

(21) Appl. No.: 16/104,987

(22) Filed: Aug. 20, 2018

(65) Prior Publication Data

US 2019/0079455 A1 Mar. 14, 2019

(30) Foreign Application Priority Data

Sep. 8, 2017 (EP) ..... 17190158

(51) Int. Cl.
*G04B 19/26* (2006.01)
*G04G 21/04* (2013.01)
*G04G 9/00* (2006.01)

(52) U.S. Cl.
CPC ..... *G04B 19/262* (2013.01); *G04G 9/007* (2013.01); *G04G 9/0064* (2013.01); *G04G 21/04* (2013.01)

(58) Field of Classification Search
CPC ..... G04B 19/262; G04G 9/0064
See application file for complete search history.

(56) References Cited

U.S. PATENT DOCUMENTS 7,154,815 B2 * 12/2006 Born ..... G04B 19/262 368/15
2013/0116967 A1 5/2013 Akcasu et al.

FOREIGN PATENT DOCUMENTS

| | | | |
|---|---|---|---|
| CN | 106537409 | A | 3/2017 |
| EP | 0 949 549 | A1 | 10/1999 |
| JP | 5-2064 | | 1/1993 |
| JP | 10-332376 | | 12/1998 |
| KR | 10-2006-0112770 | | 11/2006 |
| WO | WO 2005/111743 | A1 | 11/2005 |

OTHER PUBLICATIONS

European Search Report dated Feb. 14, 2018 in European application 17190158.0, filed on Sep. 8, 2017 (with English Translation of Categories of Cited Documents).
Chinese Office Action dated Nov. 23, 2020 in Chinese Patent Application No. 201811031224.3 (with English translation), 8 pages.

* cited by examiner

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A horological device designed to indicate the position of a celestial body or planet in the sky relative to the user. The horological device includes two hands, which rotate within the main plane of the timepiece to display the position of the celestial body or planet selected by the user. One hand is used to indicate the location of the selected celestial body or planet relative to the user's horizontal plane, while the second hand is used to indicate the location of the selected celestial body or planet relative to the user's vertical plane. Thus, the user can directly see the celestial body in the sky by following the directions given by the hands of the display system. The horological device can be used to display either the current time or position of the selected celestial body or planet by simply switching the mode of operation.

9 Claims, 2 Drawing Sheets

ASTRONOMICAL HOROLOGICAL DEVICE

This application claims priority from European patent application No. 17190158.0 filed on Sep. 8, 2017, the entire disclosure of which is hereby incorporated herein by reference.

FIELD OF THE INVENTION

The invention relates to an astronomical horological device, for example a wristwatch, capable of indicating the position of a celestial body in the solar system.

BACKGROUND

Such a watch is known for example from document EP 0 949 549, which describes a watch designed to display the position of a celestial body (planets or sun) in the zodiac at the current date or some other date. According to one of the embodiments described, with a purely analogue display, the watch comprises a dial in the form of an annulus which at its periphery bears a graduation in hours and in minutes, and inside this the symbols of the twelve signs of the zodiac, as well as depictions of the four main phases of the moon. The watch also comprises a rotary bezel bearing symbolic depictions of the celestial bodies that can be selected by rotating the bezel until the symbol of the chosen celestial body is in the 12 o'clock position. The position of the selected celestial body in a sign of the zodiac is then calculated then displayed by positioning the minutes hand in a position in which it simultaneously indicates the sign of the zodiac in which the selected celestial body is located and the approximate position of said body within the sign of the zodiac in question, respectively using the symbols 18 and the hours and minutes graduation 17 of the dial 16.

Such a watch makes it possible to display the sign of the zodiac in which a celestial body is located and the position of the said celestial body in the said sign of the zodiac at a given date. However, it does not allow a user easily to find the selected celestial body in the sky if the user does not know how to locate the relevant sign of the zodiac. In addition, given the number of symbols displayed on the dial and the bezel of the watch, this information is not always easy to read.

SUMMARY OF THE INVENTION

The invention proposes a novel horological device making it possible to identify the position of a celestial body in the sky and thus give an uninitiated user simple means for identifying the said celestial body or planet in the sky. To that end, the invention proposes a timepiece designed to indicate the position of a celestial body, characterized in that it comprises:

- a circuit for determining a current time,
- a circuit for determining a geographical position of the timepiece,
- a means designed to determine the position of the celestial body as a function of the current time and of the geographical position of the timepiece,
- a display system comprising a first hand, a second hand and a means designed to drive the rotation of the said hands in a main plane of the timepiece to display the determined position of the celestial body.

The horological device according to the invention thus directly displays the position in the sky of the celestial body sought. The user can thus directly see the celestial body in the sky, by following the directions given by the hands of the display system.

According to one embodiment, the position of the celestial body is determined in a horizontal coordinates system centred on the timepiece using an azimuth ($\alpha_A$) and an angle of elevation ($\beta_A$), which coordinate system is defined by a horizontal plane ($X_0$, $Y_0$) and a vertical axis ($Z_0$), the horizontal plane comprising a cardinal axis ($X_0$), the hand driving means being designed to determine a cardinal axis in the horizontal plane and to orient a first hand with respect to the cardinal axis according to the determined azimuth of the celestial body. The azimuth of the celestial body in space is thus directly accessible to the user who can easily orientate himself in the horizontal plane.

According to one embodiment also, the means for driving the hands is designed to position a second hand, in the horizontal plane with respect to a reference axis ($X_M$) associated with the timepiece, at an angle $\beta$ equal to the angle of elevation $\beta_A$ of the celestial body. As an alternative, the means for rotating the hands may be designed to orient the second hand with respect to the horizontal plane at the determined angle of elevation $\beta_A$ of the celestial body.

According to one embodiment, the horological device may also comprise a means for selecting a celestial body from a plurality of celestial bodies.

Finally, according to one embodiment implementation, the horological device is of the wristwatch type, making it easier to use on the move.

BRIEF DESCRIPTION OF THE FIGURES

The invention will be described hereinafter in greater detail with the aid of the attached drawings, given by way of entirely nonlimiting examples, in which.

DETAILED DESCRIPTION OF THE INVENTION

Figure 2:
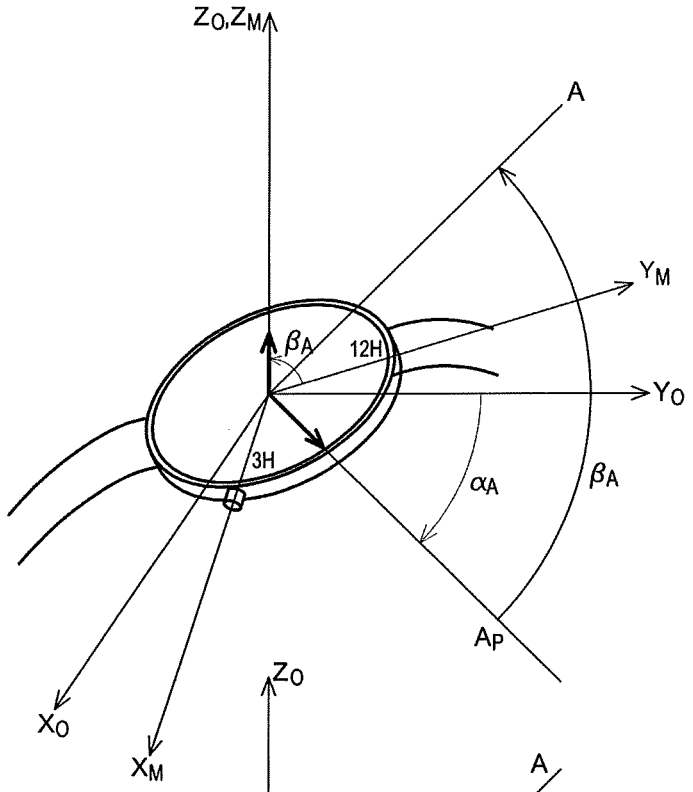
FIG. 2 is a horological device according to the invention, in some arbitrary position
Figure 3:
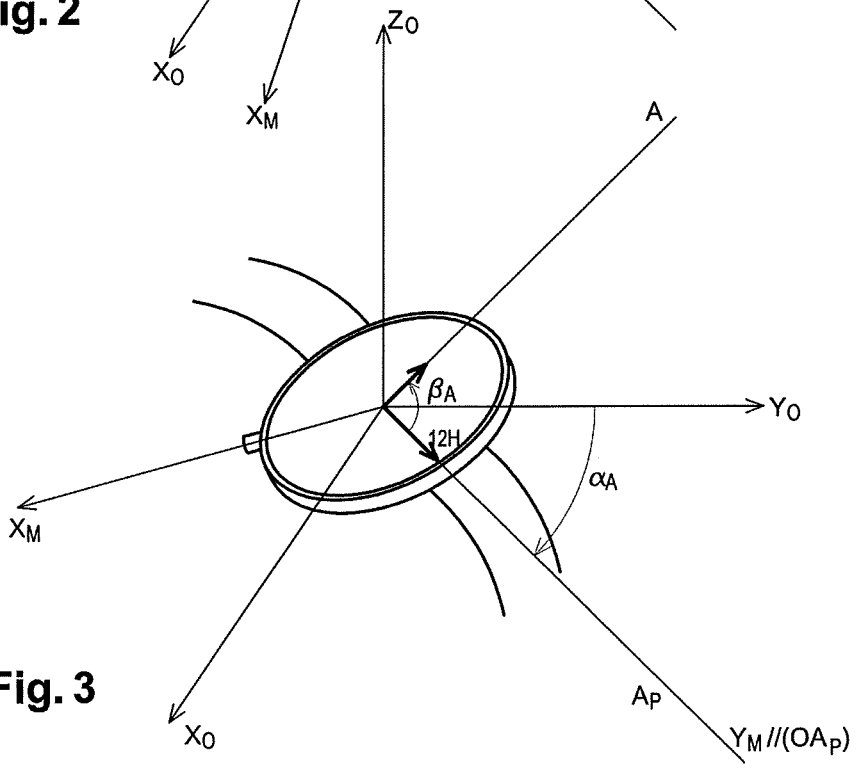
FIG. 3 is a horological device according to the invention in a position correlated to the position of a celestial body to which it is pointing

As stated previously, the invention relates to a horological device or a timepiece designed to indicate the position of a celestial body. In the example depicted in FIGS. 2 and 3, the timepiece is a wristwatch, although other timepieces may be envisaged, such as a pocket watch, a chronometer, etc.

Figure 4:
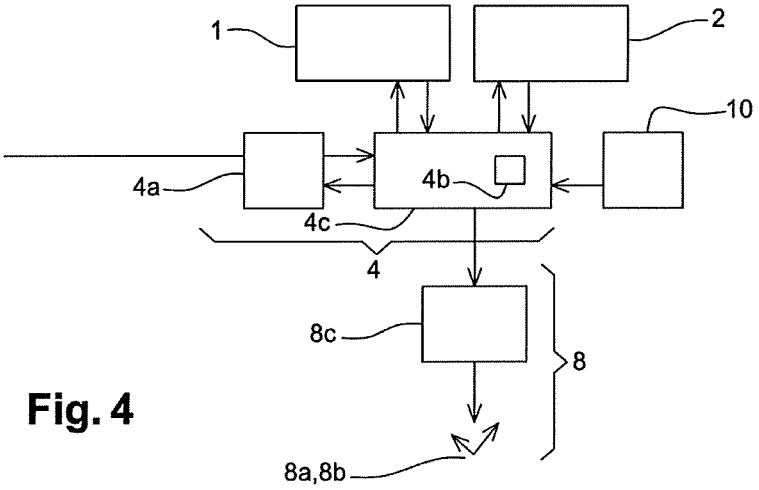
FIG. 4 is a block diagram representing the essential components of a horological device according to the invention.

The elements of the timepiece that are essential to implementation of the invention are depicted schematically in FIG. 4:

- a circuit 1 for determining a current time,
- a circuit 2 for determining a geographical position of the timepiece,
- a means 4 designed to determine the position of the celestial body as a function of the current time and of the geographical position of the timepiece,
- a display system comprising a first hand 8*a*, a second hand 8*b* and a means 8*c* designed to drive the rotation of the said hands in a main plane of the timepiece and to display the determined position of the celestial body.

From a practical standpoint, in the chosen example of a watch, all the components are grouped together in the conventional way into a case middle to which the ends of two strands of a bracelet strap are attached. The case middle is fitted with a back and closed on the top by a crystal. The two hands 8*a*, 8*b* in this instance move past a dial in the form of an annulus which at its periphery is graduated in hours and in minutes and/or in degrees.

A Cartesian coordinates system associated with the timepiece is defined by two axes $X_M$, $Y_M$ which are perpendicular to one another and both perpendicular to an axis $Z_M$ of rotation of the hands, the three axes intersecting at a point O. In the example depicted in the figures, the axis $Y_M$ points towards a graduation of the dial that corresponds to 12 o'clock and the axis $X_M$ points towards a graduation of the dial that corresponds to 3 o'clock. $X_M$ and $Y_M$ define the main plane of the timepiece.

The circuit 1 is produced according to a layout that is conventional in horology circles; essentially, it comprises a time base for producing a standard frequency signal and a circuit designed to determine the current time from the said standard frequency signal.

The positioning circuit 2 is also known from elsewhere; it is, for example a GPS (Global Positioning System) chip or the like, able to determine a geographical position on the earth from signals that it receives from a satellite positioning system.

The display system 8 is, in the context of the invention, an analogue system comprising at least two hands 8*a*, 8*b* and a means 8*c* for controlling the position of the hands. Of course, the display system may also comprise other elements such as other hands, electro optical display cells for a digital display of pseudo analogue type, for example of the pseudo analogue type, etc., which may be of use elsewhere for other functions of the timepiece. In the context of the invention, the display system is designed to:

- in a first mode of operation of the timepiece, display the current time, and
- in a second mode of operation of the timepiece, display the determined position of the celestial body.

The means 4 essentially comprise a data memory 4*a*, a program memory 4*b*, and a processing unit 4*c*.

The data memory 4*a* may notably comprise a map of the sky stored in the form of a database comprising a list of the celestial bodies (at least one celestial body) that can be pointed to and, for each identified celestial body, data indicative of its position in the solar system in relation to the earth. From a practical standpoint, the data memory may be positioned in the immediate vicinity of the processing unit 4*c*, in a case of the timepiece. As an alternative, all or part of the data memory can be offloaded into a remote data server. In that case, the means 4 will also comprise suitable emission and reception means for accessing the data on the data server. As a further alternative, the data memory 4*a* and the program memory 4*b* are two parts of the one same memory.

The program memory 4*b* stores a program that can be run by the processing unit; the said program notably comprises a plurality of lines of code suitable for implementing the functions of the processing unit 4*c* and, notably, in the context of the invention, the function that consists in determining the position of a selected celestial body as a function of the current time and the geographical position of the timepiece, and in making the said display system 8 display the determined position. In the conventional way, the processing unit also implements a function which consists in making the display system 8 display the current time.

The processing unit 4*c* is connected to the circuit 1 in order to receive information relating to the current time. Within the context of the invention, the processing unit is also connected to the circuit 2 to receive information relating to the geographical position of the timepiece. The processing unit may alternatively be connected to a selection means 10 in order to receive information relating to the celestial body the position of which is to be displayed. To complement this, the processing unit may be connected to a remote server by any suitable wireless link (WiFi, etc.) in order to receive data or instructions from a remote server.

The second mode of operation of the timepiece, which is specific to the invention and allows the determined position of the celestial body to be displayed, will now be described in detail.

Figure 1:
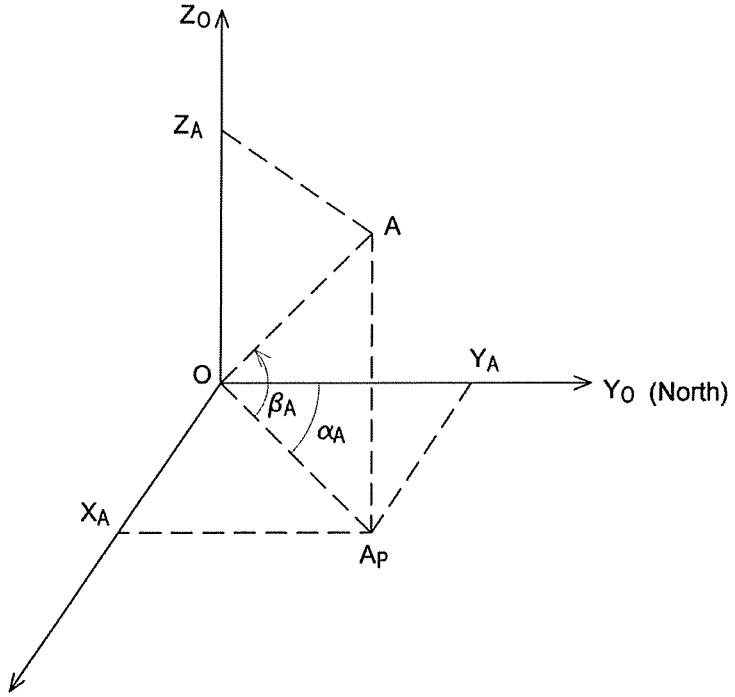
FIG. 1 is a diagram showing the coordinates of a celestial body in a horizontal coordinates system

In the known way, within a Cartesian coordinates system (FIG. 1) defined by a centre O and three mutually perpendicular axes $X_0$, $Y_0$, $Z_0$, the position of a celestial body likened to a point A may be defined by three coordinates ($X_A$, $Y_A$, $Z_A$) corresponding to the projection of the point A onto the axes $X_0$, $Y_0$ and $Z_0$ respectively. More commonly in the field of astronomy, celestial bodies are identified in a horizontal coordinates system centred on an observer standing on the ground on Earth. A horizontal coordinates system divides the sky into two hemispheres: one situated above a viewpoint O and the other situated below. The great circle separating the two hemispheres defines a horizontal plane, from which there are established an azimuth $\alpha_A$ and an angle of elevation $\beta_A$, which constitute the two key coordinates of a celestial body in this system. The horizontal plane passing through O is, in practice, a plane parallel to a plane tangential to the Earth and passing through the projection of the point O onto the ground. For the sake simplicity, in FIG. 1, the timepiece is positioned at the point O and the horizontal plane is considered to be the plane ($X_0$, $Y_0$) and cardinal north corresponds to the axis $Y_0$. The azimuth $\alpha_A$ is the angle between a cardinal (cardinal north corresponding to the axis $Y_0$ in FIG. 1) and the projection (straight line $OA_P$) of the selected celestial body onto the horizontal plane ($X_0$, $Y_0$). The azimuth $\alpha_A$ is generally expressed in degrees, from 0° to 360° in the clockwise direction starting from cardinal north. The angle of elevation $\beta_A$ is the vertical angle between the horizontal plane and the celestial body being sighted, expressed in degrees, in the anticlockwise direction from the vertical plane.

In a horizontal coordinates system thus defined, the position of a celestial body A is dependent on the position of the centre O and of the horizontal plane in space, and these are themselves dependent on the geographical position on Earth of the observer, and on the position of the Earth with respect to the celestial body within the solar system. The position of the Earth with respect to the celestial body is dependent on the current time and on the current date. The geographical position of the timepiece as determined by the circuit 2 and the current time and date determined by the circuit 1, combined with the information stored in memory in the data memory 4*a* thus allow the processing unit 4*c* to determine the position of the celestial body in a horizontal coordinates system centred on the timepiece, using computational methods which are admittedly complex but widely known in the field of astronomy.

The means 8*c* for driving the display hands 8*a*, 8*b* is designed to determine the cardinal axis $Y_0$ (for example cardinal north) and to orient a first hand with respect to the cardinal axis $Y_0$ according to the determined azimuth $\alpha_A$ of the celestial body A; the said hand is, for example, the hand usually used to display the minutes of the current time. In order to perform this orientation, the hand control means may for example comprise a magnetometer 2D able to determine cardinal north $Y_0$ and a means for positioning the first hand in the horizontal plane and keeping it in position, with respect to cardinal north according to the azimuth $\alpha_A$ of the celestial body, the first hand moreover being left free to turn in the main plane of the timepiece. The orientation of the first hand is independent of the coordinate system associated with the timepiece which means that this orientation $\alpha_A$ is maintained whatever the movements of the timepiece so long as the main plane of the timepiece remains in the horizontal plane. Thus, by positioning the main plane of the timepiece in the horizontal plane and looking in the direction indicated by the pointing of the first hand, the observer is always looking in the direction of the azimuth $\alpha_A$ of the selected celestial body, even if the timepiece moves position. The first hand thus behaves like the needle of a compass which will be attracted in a direction forming an angle $\beta_A$ with cardinal north.

The angle of elevation $\beta_A$ of the celestial body can be displayed on the timepiece using the second hand (for example the hand usually used to display the hours of the current time), in a number of ways.

According to one embodiment, the means for controlling the hands is designed to position the second hand, in the main plane ($X_M$, $Y_M$) and with respect to a reference axis $Y_M$ associated with the timepiece, at an angle $\beta$ equal to the angle of evaluation $\beta_A$ of the celestial body in the horizontal coordinates system centred on the timepiece for practical considerations to position the second hand, the control means 8*c* rotates the second hand in the main plane in the conventional way and then immobilizes the hand. In this embodiment, the angle $\beta$ is defined with respect to the reference axis $Y_M$ associated with the timepiece so that if the timepiece is moved, the angle $\beta$ remains constant. In this embodiment, in order to look at the celestial body, the observer can use the timepiece as follows. The timepiece is oriented in the horizontal plane in such a way that the first hand (oriented according to the azimuth of the celestial body), free to rotate, is aligned along the reference axis $Y_M$ of the timepiece (corresponding to the 12 o'clock mark in this example). Next, the timepiece is turned about the reference axis $Y_M$, keeping the reference axis $Y_M$ fixed in the horizontal plane so that the plane formed by the axis $Y_M$ and the second hand is vertical. The observer can then view the selected celestial body by looking in the direction in which the end of the second hand is pointing.

According to another embodiment, the means for rotating the hands is designed to orient the second hand with respect to the horizontal plane at the angle of elevation $\beta_A$ of the celestial body in the horizontal coordinate system centred on the timepiece.

In order to perform this orientation, the means for driving the hands may comprise for example a 3D magnetometer able to determine cardinal north and a means for:

- positioning the first hand in the horizontal plane and keeping it in position with respect to cardinal north at an angle equal to the azimuth $\alpha_A$ of the celestial body,
- positioning the second hand in a vertical plane and maintaining it in position with respect to the horizontal plane at an angle equal to the angle of elevation $\beta_A$ of the celestial body.

The first hand and the second hand are incidentally left free to rotate in the main plane of the timepiece. Like with the first hand, the orientation of the second hand here is independent of the coordinate system associated with the timepiece, which means that this orientation $\beta_A$ is maintained whatever the movements of the timepiece in a vertical plane. The hands thus behave like the needle of a compass, but attracted towards the celestial body.

In this embodiment, in order to look at the celestial body, the observer may use the timepiece as follows. The timepiece is oriented in the horizontal plane in such a way that the first hand (oriented along the azimuth of the celestial body), free to rotate, is aligned along the reference axis $Y_M$ of the timepiece (corresponding to the 12 o'clock mark in this example). Next, the timepiece is turned about the reference axis $Y_M$, keeping the reference axis $Y_M$ fixed in the horizontal plane so that the plane formed by the axis $Y_M$ and the second hand is vertical. Finally, the timepiece is oriented in the vertical plane in such a way that the second hand (oriented along the angle of elevation of the celestial body), free to rotate, is also aligned along the reference axis $Y_M$ of the timepiece. Then, when the two hands are aligned with the reference axis $Y_M$, the observer can view the selected celestial body by looking in the direction in which the tip of the two hands is pointing.

According to an alternative form of the embodiment it would also be possible to envisage validating the azimuth and elevation orientation by means of an audible signal or vibration which is triggered when the azimuth and elevation for viewing the determined celestial body are achieved.

The timepiece according to the invention may further comprise a selection means 10 for selecting a mode of operation of the timepiece. The means 10 in one definitely nonlimiting example is an rotary operating stem with a number of axial positions, each axial position corresponding to one mode of operation of the timepiece.

The timepiece according to the invention may further comprise a means for selecting a celestial body from a plurality of celestial bodies recorded in the memory 4*a*. In one definitely nonlimiting example, the means for selecting a celestial body may comprise:

- a digital display element,
- an incrementation means that allows the user to display the celestial bodies from a list contained in the data memory successively on the digital display element, and
- a validation means such as a control button that the user can actuate in order to select the celestial body displayed.

According one embodiment, the incrementation means may be a control button, successive presses of the button allowing scrolling through the celestial bodies on the list. As an alternative, the incrementation means may be the rotary control stem in an axial position associated with the second mode of operation of the timepiece (displaying the position of a celestial body), rotation of the stem leading to a scrolling through the list of celestial bodies.

It may even be possible in an advantageous alternative form to make the provision that, when the celestial body selected by the user cannot be seen from the location at which the user is situated, means are provided for informing the user of this state of affairs, for example by using suitable control of the motor which drives the hands to bring these hands into a characteristic position.

According to another alternative form of embodiment, it might be possible to envisage selecting the celestial body that is to be observed on a remote terminal away from the watch, such as a mobile phone, a tablet or the like, and for the corresponding selection to be sent across by wireless or computer communication, or another means of communication. It goes without saying that, in this case, the watch will comprise an antenna and/or a socket and an appropriate receiver circuit.

KEY TO FIGURES

1. Circuit for determining the current time
2. Circuit for determining geographical position
4. Means for determining the position of a celestial body
4*a* Data memory
4*b* Program memory
4*c* Processing unit
8. Display system
8*a*, 8*b*: two hands
8*c* means for driving the hands
10. Means for selecting a mode of operation

What is claimed is:

1. A horological device designed to indicate the position of a celestial body, comprising:

a circuit for determining a current time, a circuit for determining a geographical position of the timepiece, a means designed to determine the position of the celestial body as a function of the current time and of the geographical position of the timepiece, an analog display system comprising a first hand, a second hand and a means designed to drive the rotation of the hands in a main plane of the timepiece and to display the determined position of the celestial body, wherein the position of the celestial body is determined in a horizontal coordinate system centered on the timepiece using an azimuth and an angle of elevation, which coordinate system is defined by a horizontal plane and a vertical axis, the hand driving means being configured to determine a cardinal axis in the horizontal plane and to orient the first hand with respect to the cardinal axis according to the defined azimuth of the celestial body, and the means for driving the hands is configured to orient the second hand with respect to the horizontal plane such that the position of the second hand within the horizontal coordinate system represents the angle of elevation of the celestial body.

2. The horological device according to claim 1, wherein the display system is designed to:

in a first mode of operation of the timepiece, display the current time, and in a second mode of operation of the timepiece, display the determined position of the celestial body.

3. The horological device according to claim 2, also comprising a selection means for selecting a mode of operation of the timepiece.

4. The horological device according to claim 1, in which the means for driving the hands is designed to position a second hand, with respect to a reference axis associated with the timepiece, at an angle $\beta$ equal to the angle of elevation $\beta_A$ of the celestial body.

5. The horological device according to claim 1, in which the means for driving the hands is designed to orient the second hand with respect to the horizontal plane at the determined angle of elevation $\beta_A$ of the celestial body.

6. The horological device according to claim 1 also comprising a means for selecting a celestial body from a plurality of celestial bodies.

7. The horological device according to claim 1, wherein the horological device is a wristwatch.

8. The horological device according to claim 1, in which the hand driving means include a motor.

9. The horological device according to claim 1, in which the first hand and the second hand are driven by the means for driving the hands to display a coordinate of the determined position of the celestial body.

* * * * *